United States Patent [19]

Tan et al.

[11] Patent Number: 4,932,525

[45] Date of Patent: Jun. 12, 1990

[54] FACTORY SEALED PACKING CONTAINER

[75] Inventors: Huynh P. Tan, Tracy; Ajay M. Marathe; Danh C. Tran, both of San Jose, all of Calif.

[73] Assignee: Advanced Micro Devices, Inc., Sunnyvale, Calif.

[21] Appl. No.: 415,822

[22] Filed: Oct. 2, 1989

[51] Int. Cl.[5] ..... B65D 85/42

[52] U.S. Cl. ..... 206/328; 206/334; 206/491; 229/178; 229/193; 229/194

[58] Field of Search ..... 206/328, 334, 491; 229/132, 160, 177, 178, 179, 193, 194

[56] References Cited

U.S. PATENT DOCUMENTS

| | | | |
|---|---|---|---|
| 1,112,442 | 10/1914 | Flack | 229/194 |
| 1,363,436 | 12/1920 | Richardson | 229/117 |
| 2,072,256 | 3/1937 | Greve | 229/160 |
| 2,146,832 | 2/1939 | mcAleer | 229/160 |
| 2,670,128 | 2/1954 | Stowitts | 229/132 |
| 3,047,203 | 7/1962 | Etlinger | 206/334 |
| 3,092,245 | 6/1963 | Poisson | 206/334 |
| 3,854,651 | 12/1974 | Osborne | 229/160 |
| 4,197,980 | 4/1980 | Johnson | 229/178 |
| 4,257,550 | 3/1981 | Frohlicher | 229/178 |
| 4,528,222 | 7/1985 | Rzpecki et al. | 206/334 |

FOREIGN PATENT DOCUMENTS

| | | | |
|---|---|---|---|
| 1132137 | 3/1957 | France | 229/194 |

*Primary Examiner*—David T. Fidei
*Attorney, Agent, or Firm*—Davis Chin

[57] ABSTRACT

A factory sealed packing container for housing a plurality of tubes is formed from a one-piece, die-cut blank of raw material that is cut, scored and foldable for easy set-up by hand or automatically into the assembled container.

9 Claims, 3 Drawing Sheets

FACTORY SEALED PACKING CONTAINER

BACKGROUND OF THE INVENTION

This invention relates generally to paperboard containers and more particularly, it relates to an improved factory sealed packing box or container for housing a plurality of tubes. Each of the tubes is preferably used to package electronic components such as leadless chip carriers, plastic lead chip carriers, and the like containing integrated circuit devices with a varying number of lead count.

As it generally known in the art, the integrated circuit devices are susceptible to not only mechanical damage due to their physical handling during manufacturing and shipment, but also can be damaged or destroyed by electrostatic discharge (ESD). Thus, the packing box material is preferably formed of a single layer "B" corrugated board which has an inner liner to provide a conductive coating. The conductive coating serves to protect the I.C. devices against ESD. Further, in order to facilitate loading of the tubes during production, the packing box must allow for top closing. The packing box is then sealed so as to present a level of quality which customers have become accustomed to in the industry. However, for convenience of the end users or customers, the packing box must be capable of being opened at either the top or at both ends so as to permit removal of the tubes.

It is desirable that the packing container be formed from a one-piece, die-cut blank of raw material which is of relatively low cost. Further, it would be expedient that the blank be easily foldable to be set-up by hand to the assembled packing box. In the alternative, it would be desirable to have the blank capable of being automatically formed into the packing box by a conventional "tray-forming" machine and then subsequently sealed automatically after loading by a conventional "autocase sealer" machine.

SUMMARY OF THE INVENTION

Accordingly, it is a general object of the present invention to provide an improved factor sealed packing container for housing a plurality of tubes and the like which is relatively simple and economical to manufacture and assemble.

It is an object of the present invention to provide a factory sealed packing container for housing a plurality of tubes which is formed from a one-piece, die-cut blank of raw material that is cut, scored and foldable for easy set-up by hand into the assembled container.

It is another object of the present invention to provide a factory sealed packing container for housing a plurality of tubes which allows for top loading during production and allows for either top opening or end opening by the customers.

It is still another object of the present invention to provide a factory sealed packing container for housing a plurality of tubes which is made of inexpensive material and construction, but yet is relatively durable and serviceable.

In accordance with these aims and objectives, the instant invention is concerned with the provision of a factory sealed packing container for housing a plurality of tubes which is formed from a one-piece, die-cut blank of material. The packing container includes a bottom wall panel, a rear wall panel, a front wall panel, an inner major cover flap, an outer major cover flap, rectangularly-shaped inner end wall panels, rectangularly-shaped outer end wall panels, a first intermediate end wall panel, a second intermediate end wall panel, end flaps, and minor cover flaps which are all suitably folded for erection. The free edges of the outer end wall panels are provided with tabs for interlocking with corresponding slots formed in the opposed side edges of the bottom panel.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
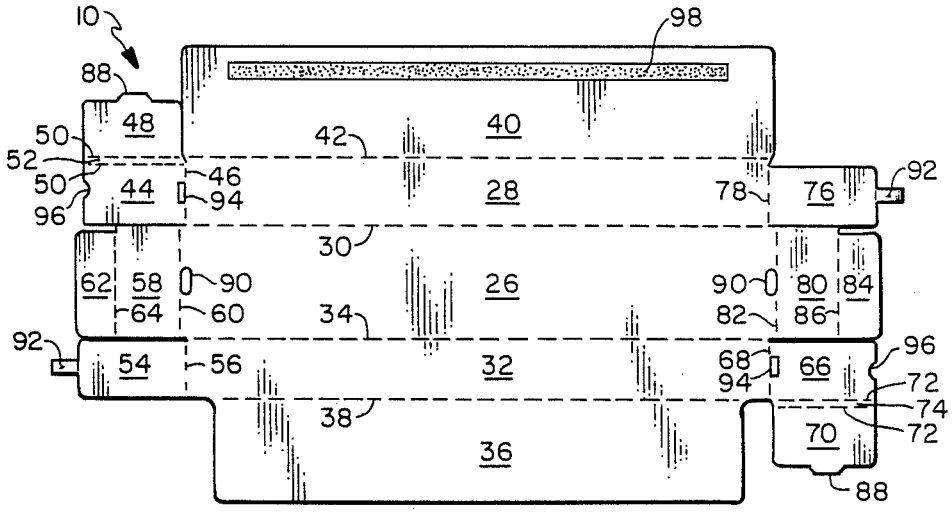
FIG. 1 is a plan view of a one-piece, die-cut blank utilized to form the container constructed according to the principles of the present invention.
Figure 8:
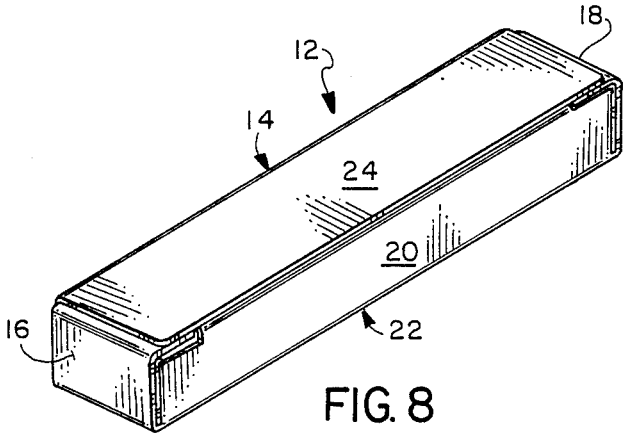
FIG. 8 is a perspective view of the packing container of the present invention in its fully assembled condition for housing a plurality of tubes.

Referring now in detail to the various views of the drawings, there is shown in FIG. 1 a one-piece, die-cut blank 10 of a single layer of suitable raw material such as "B" corrugated paperboard or the like which is utilized to form a factory sealed packing container or box 12 for housing a plurality of tubes (not shown). Each of the tubes is preferably used to package electronic components such as leadless chip carriers, plastic lead chip carriers, and the like which houses integrated circuit devices with a varying number of lead count. The assembled packing container 12, as illustrated in FIG. 8, is provided with an upright, rectangularly-shaped back or rear wall 14, oppositely-disposed end walls 16 and 18, a front wall 20, a bottom wall 22 and a top wall 24.

While the respective walls of the packing box 12 may be of various dimensions, it should be of such capacity so that the quantity of tubes contained therein is small enough to make it practical for the customer to order parts only in multiples of that quantity. In the preferred embodiment, the height of the back and front walls is approximately 2 inches, the depth is approximately 3 3/4 inches, and the width is approximately 21 1/8 inches.

In order to provide protection against electrostatic discharge (ESD), the blank 10 of FIG. 1 is formed on its top surface with an inner liner of conductive coating. Further, the blank 10 has formed on its bottom surface an outer liner which is bleached and printable. This outer liner may be printed with designs and logos which will make the packing box more aesthetically attractive when received by the customers. Further, the outer liner can be printed with the other useful information, i.e., pertaining to the ESD requirement.

Referring again to FIG. 1, the blank 10 comprises a rectangularly-shaped bottom wall panel 26 to which a rectangularly-shaped rear wall panel 28 is attached along a fold line 30. A rectangularly-shaped front wall panel 32 is attached to the bottom panel 26 along a fold line 34. An inner major cover flap 36 is hingedly joined along a fold line 38 to the front wall panel 32. An outer major cover flap 40 is hingedly attached along a fold line 42 to the rear wall panel 28.

A rectangularly-shaped inner end wall panel 44 is connected to the rear wall panel 28 along a fold line 46. A rectangularly-shaped outer end wall panel 48 is secured to the inner end wall panel 44 along double fold lines 50 which defines a narrow connecting panel 52 therebetween. An intermediate end wall panel 54 is connected to the front wall panel 32 along a fold line 56. An end flap 58 is hingedly joined to the bottom wall panel 26 along a fold line 60. A minor cover flap 62 is secured to the end flap 58 along a fold line 64.

Similarly, a rectangularly-shaped inner end wall panel 66 is connected to the front wall panel 32 along a fold line 68. A rectangularly-shaped outer end wall panel 70 is secured to the inner end wall panel 68 along double fold lines 72 which defines a narrow connecting panel 74 therebetween. An intermediate end wall panel 76 is connected to the rear wall panel 28 along a fold line 78. An end flap 80 is hingedly joined to the bottom wall panel 26 along a fold line 82. A minor cover flap 84 is secured to the end flap 80 along a fold line 86.

In the intermediate area of the free edges of the outer end wall panels 48 and 70, there are provided tabs or projections 88. Each of the projections 88 are adapted to interlock within a corresponding one of slots 90 formed in the bottom wall panel 26 along the fold lines 60 and 82 when the blank 10 is set up so as to maintain the outer end wall panels 48, 70 and inner end wall panels 44, 66 in the erected position. Further, each of the intermediate end wall panels 54 and 76 is provided with an extension panel 92 formed integrally on its free edge thereof. The extension panels 92 are adapted to extend through a corresponding one of slots 94 formed in the inner end wall panels 46, 66 along the respective fold lines 46, 68 for interlocking engagement. The inner end wall panels 44, 66 also include an arcuate cut-out portion or opening 96 of a semicircular-shape on their free edges which are used to facilitate end opening of the container, as will be described more fully hereinafter.

It will be noted that the width dimension of the inner cover flap 36 is somewhat smaller than the width dimension of the outer cover flap 40. The inner and outer cover flaps are secured in fully overlapped relationship by glue 98 or adhesive tape so as to form the fully assembled packing container 12 of FIG. 8.

Figure 2:
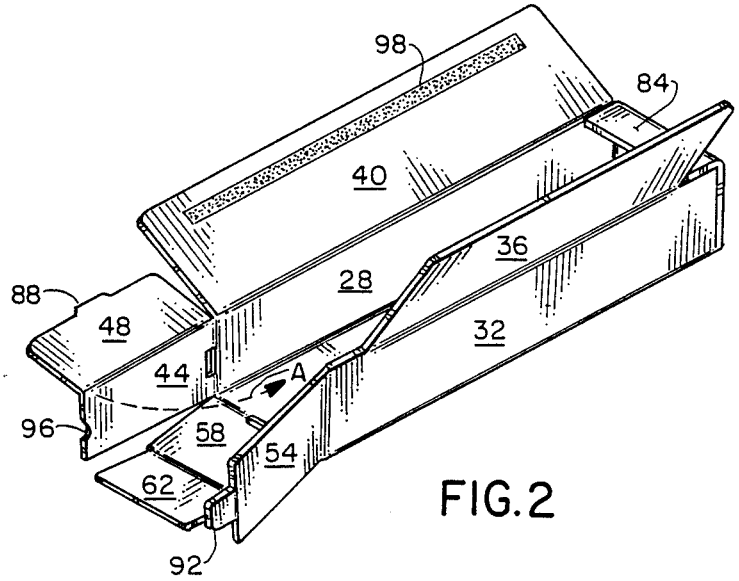
FIG. 2 is a perspective view illustrating an initial folding of the blank of FIG. 1 to form the packing container of FIG. 8.

In order to form the fully assembled factory sealed packing container 12 of FIG. 8, the blank 10 is initially forwarded as shown in FIG. 2. As illustrated therein, the rear wall panel 28 and front wall panel 32 are bent vertically upward about their respective fold lines 30, 34. Next, the inner end wall panel 44 is folded inwardly at the right angle to the rear wall panel 28 along the fold line 46 in the direction of arrow A. It will be understood that the inner end wall panel 66 is folded in a similar manner with respect to the front wall panel 32.

Figure 3:
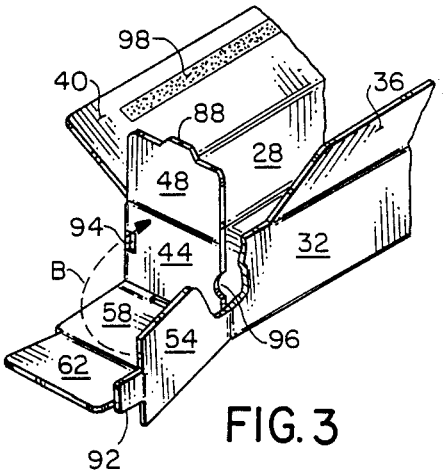
FIGS. 3 through 7 are perspective views illustrating further folding steps of the blank of FIG. 1.
Figure 4:
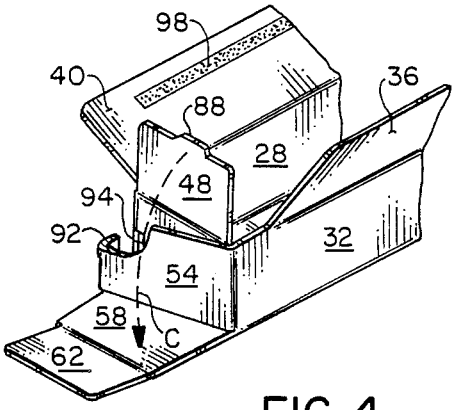
Figure 5:
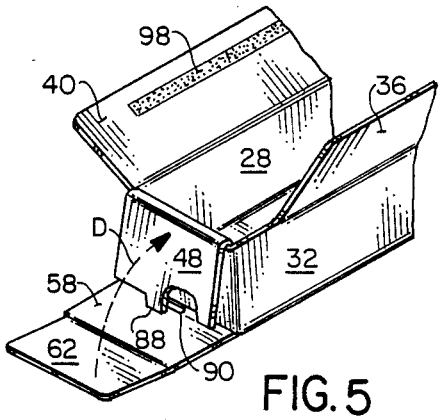

Next, as depicted in FIG. 3, in this position the intermediate end wall panel 54 is bent inwardly at a right angle to the front wall panel 32 along the fold line 56 in the direction of arrow B. The extension panel 92 of the intermediate end wall panel 54 is inserted into and through the slot 94 formed in the inner end wall panel 44 so as to form an interlocking engagement. This is shown in FIG. 4. Again, the intermediate end wall panel 76 is folded and is secured in a similar manner with respect to the inner end wall panel 66. Then, the outer end wall panel 48 is further folded downwardly in the direction of arrow C (shown in FIG. 4) so that the projection or tab 88 is interlocked or engaged within the corresponding slot 90 in the bottom wall panel 26, as illustrated in FIG. 5. The outer end wall panel 70 is folded and secured in a like fashion. It will be noted that the intermediate end wall panels 54 and 76 are sandwiched between the respective ones of the inner end wall panels 44, 66 and the outer end wall panels 48, 70.

Figure 6:
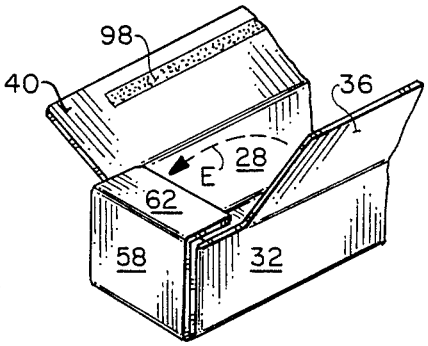
Figure 7:
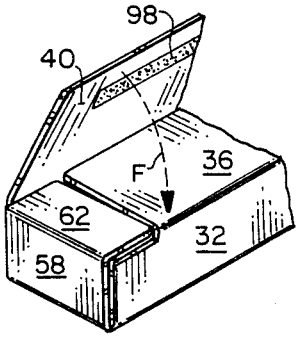

Next, the end flap 58 is bent upwardly at a right angle to the bottom wall panel 26 along the fold line 60 in the direction of arrow D. The end flap 80 is simultaneously folded along the fold line 82. After loading a plurality of tubes of devices, the minor cover flaps 62 and 84 are folded downwardly and inwardly to the position shown in FIG. 6. Then, the major inner cover flap 36 is folded downwardly and inwardly in the direction of arrow E so that their side edges are disposed adjacent the free edges of the minor cover flaps 62 and 84, as illustrated in FIG. 7. Finally, the major outer cover flap 40 is folded downwardly and inwardly in the direction of arrow F so as to be in fully overlapped relationship with the major inner cover flap 36. The strip of glue 98 may be applied to the inner surface of the outer cover flap 40 prior to the folding of the same so as to form a fully assembled factory sealed packing container shown in FIG. 8. Alternatively, an adhesive tape may be used to secure the inner and outer cover flaps together.

Figure 9:
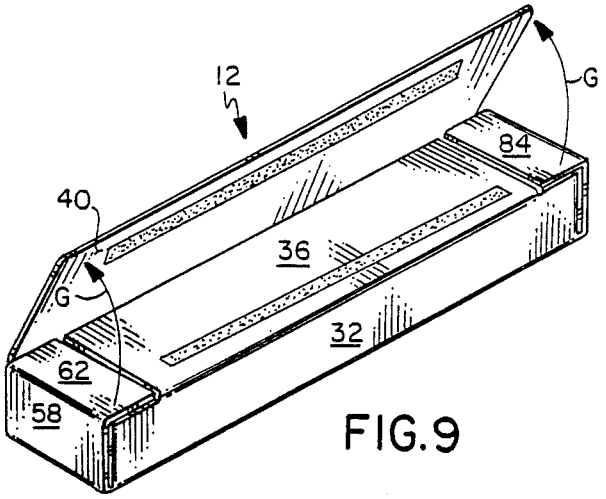
FIG. 9 is a perspective view, illustrating a top opening of the assembled packing container.

In FIG. 9, there is shown a top opening method for the packing container 12. This is achieved by breaking the glue seal or adhesive tape and subsequently lifting of the major outer cover flap 40 in the direction of arrow G. Then, the major inner cover flap 36 is lifted to provide access to the plurality of tubes.

Figure 10A:
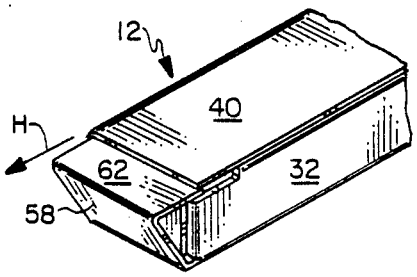
FIGS. 10A and 10B are perspective views, illustrating an end opening of the assembled packing container.
Figure 10B:
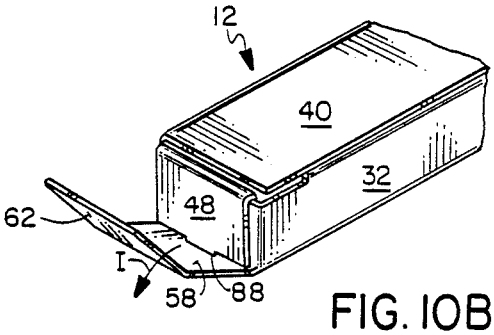

In FIGS. 10A and 10B, there is shown an alternate end opening method for the packing container 12. This is achieved by initially pulling outwardly minor cover flap 62 in the direction of arrow H, which had been tucked underneath the major outer cover flap 40. Then, the minor cover flap 62 is pulled downwardly in the direction of arrow I so as to release the tab 88 on the outer end wall panel 48 from the slot 90 in the bottom wall panel 26. In order to complete the end opening method from the position of FIG. 5 to the position of FIG. 2, it is only necessary to unfold the packing container 12 through the steps illustrated in FIGS. 4, 3 and 2. A finger of the end user or customer can be inserted into the opening 96 of FIG. 3 for pulling outwardly the inner end wall panel 44, thereby facilitating end opening of the container. It should be apparent that either of the end walls 16, 18 of the box can be opened in this fashion.

Figure 11:
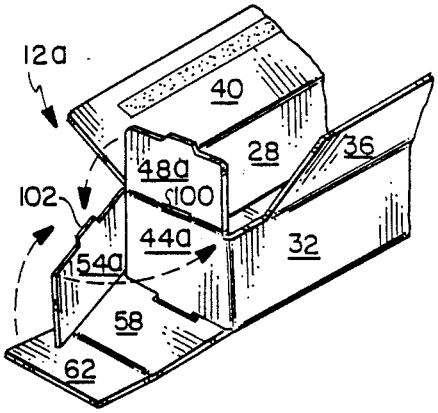
FIG. 11 is a perspective view of a second embodiment of a packing container.

A second embodiment of a packing container **12*a* is shown in FIG. 11. By comparing FIGS. 11 and 3, it can be seen that the one difference is that a slot 100 is formed in the inner end wall 44*a* on its top edge in FIG. 11 rather than having the slot 94 on the side edge in FIG. 3. Also, the arcuate opening 96 has been eliminated. Further, a tab or projection 102 is formed on the top edge of the intermediate end wall panel 54***a* of FIG. 11 rather than having the extension panel 92 shown in FIG. 3. Thus, the tab 102 is adapted to interlock with the slot 100. Except for these differences, the assembling and opening of the package container 12*a* is identical to that described with respect to the packing container 12.

Figure 12:
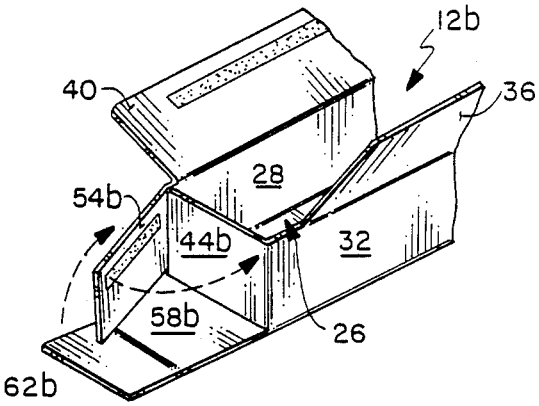
FIG. 12 is a perspective view of a third embodiment of a packing container.

Further, a third embodiment of a packing container 12*b* is shown in FIG. 12. By comparing FIGS. 12 and 11, it can be seen that the outer end wall panel 48*a* of FIG. 11 and associated tabs and slots have been eliminated in FIG. 12. As a result, the packing container 12*b* of FIG. 12 can be formed automatically from a die-cut blank by a conventional "tray-forming" machine and the inner end wall panel 44*b*, outer end wall panel 54*b*, and end flap 58*b* can be hot glue sealed automatically by a conventional "auto-case sealer" machine.

From the foregoing detailed description, it can thus be seen that the present invention provides an improved factory sealed packing container for housing a plurality of tubes which is formed from a one-piece die-cut blank of material that is cut, scored and foldable for easy set-up by hand or automatically into the assembled container. Further, the packing container permits ready access to its interior by either a top opening method or an end opening method.

While there has been illustrated and described what is at present considered to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best mode contemplated for carrying out the invention, but that the invention will include all embodiments falling within the scope of the appended claim.

What is claimed is:

1. A factory sealed packing container for housing a plurality of tubes, comprising:

a bottom wall panel (26) having a rear, front and opposed side edges;

a rear wall panel (28) connected along a fold line to the rear edge of said bottom wall panel (26) and extending up at right angles thereto:

a front wall panel (32) connected along a fold line to the front edge of said bottom panel (26) and extending up at right angles thereto;

an inner major cover flap (36) hingedly joined along a fold line to an upper edge of said front wall panel (32) and extending inwardly at right angles thereto;

an outer major cover flap (40) hingedly attached along a fold line to an upper edge of said rear wall panel (28) and extending inwardly at right angles thereto;

rectangularly-shaped inner end wall panels (44, 66) connected along fold lines to side edges of said respective rear and front wall panels (28, 32) and extending inwardly at right angles thereto;

rectangularly-shaped outer end wall panels (48, 70) connected along fold lines to upper edges of said inner end wall panels (44, 66) and extending downwardly therefrom in a spaced apart parallel relationship therewith;

a first intermediate end wall panel (54) connected along a fold line to a side edge of said front wall panel (32) and extending inwardly therefrom between said inner and outer end wall panels (44, 48);

a second intermediate end wall panel (76) connected along a fold line to a side edge of said rear wall panel (28) and extending inwardly therefrom between said inner and outer end wall panels (66, 70);

end flaps (58, 80) connected to said opposed side edges of said bottom panel (26) and extending upwardly at right angles thereto; and minor cover flap (62, 84) hingedly attached to respective upper edges of said end flaps (58, 80) and extending inwardly therefrom underneath said outer major cover flap (40).

2. A packing container as claimed in claim 1, wherein the free edges of said first and second intermediate end wall panels (54, 76) are provided with extension panels (92) for interlocking engagement with corresponding slots (94) formed in said inner end wall panels (44, 66).

3. A packing container as claimed in claim 2, wherein the free edges of said outer end wall panels (48, 70) are provided with tabs (88) for interlocking with corresponding slots (90) formed in the opposed side edges of said bottom panel (26).

4. A packing container as claimed in claim 3, wherein the free edges of said inner end wall panels (44, 66) are provided with arcuate openings (96) to facilitate end opening of the container.

5. A packing container as claimed in claim 1, wherein the inner surfaces of said container is provided with an inner liner of conductive coating so as to protect against electrostatic discharge.

6. A packing container as claimed in claim 1, wherein said rear and front wall panels (28, 32) have the height of approximately 2 inches and has a width of approximately 21 1/8 inches.

7. A packing container as claimed in claim 1, wherein upper free edges of said first and second intermediate end wall panels (54, 76) are provided with tabs (102) for interlocking with corresponding slots (100) formed in the upper edges of said inner end wall panels (44, 66).

8. A packing container as claimed in claim 7, wherein the free edges of said outer end wall panels (48, 70) are provided with tabs (88) for interlocking with corresponding slots (90) formed in the opposed side edges of said bottom panel (26).

9. A packing container as claimed in claim 1, wherein the free edges of said inner end wall panels (44, 66) are provided with arcuate openings (96) to facilitate end opening of the container.

* * * * *